United States Patent [19]

Rowlson et al.

[11] 3,976,112

[45] Aug. 24, 1976

[54] REFUSE CUTTER AND TRIM SAW UNIT

[75] Inventors: Peter C. Rowlson, Eugene, Oreg.; Ronald J. Schneider, Jasper, Ind.

[73] Assignee: North American Products Corporation, Atlanta, Ga.

[22] Filed: Oct. 22, 1975

[21] Appl. No.: 624,958

[52] U.S. Cl. ..... 144/223; 83/698; 144/237; 241/297

[51] Int. Cl.[2] ..... B27B 33/20

[58] Field of Search ..... 144/223, 222, 218, 236, 144/237, 133 R; 241/277, 292.1, 297; 83/663, 664, 665, 698, 676; 29/103, 103 B, 104 R

[56] References Cited

UNITED STATES PATENTS

| | | | |
|---|---|---|---|
| 321,828 | 7/1885 | Loar | 144/236 |
| 792,967 | 6/1905 | Connell | 144/223 X |
| 2,014,812 | 9/1935 | Phillips | 83/665 X |
| 3,675,526 | 7/1972 | Bush | 144/237 X |

*Primary Examiner*—Othell M. Simpson
*Assistant Examiner*—W. D. Bray

[57] ABSTRACT

A cone hogger unit has axially juxtaposed cutting elements resembling circular saw blades that stepwise increase in diameter from one axial end of the unit. A cutting element intermediate the axial ends of the unit is integral with a body member that has opposite axially projecting hub-like portions, each extending through cutting elements at its axial side of said one cutting element. Circumferentially spaced screws, parallel to the unit axis and at one distance therefrom, pass through the smaller diameter cutting elements and are threaded into said one cutting element. The larger diameter elements are similarly secured by other screws at a greater distance from the unit axis.

7 Claims, 2 Drawing Figures

REFUSE CUTTER AND TRIM SAW UNIT

Figure 1:
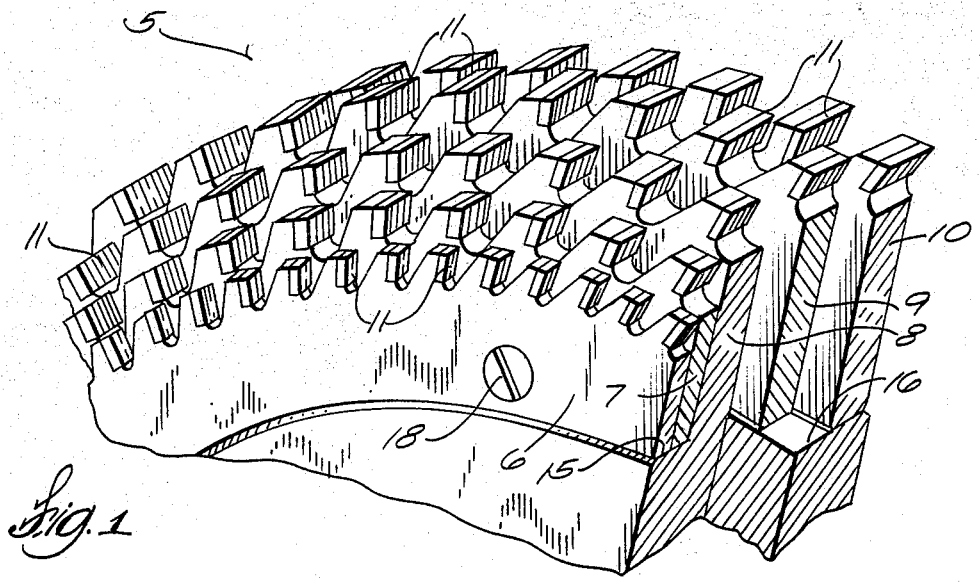

This invention relates to refuse saws, also known as hogging cutters; and the invention relates more particularly to improvements in hogging cutters of the type disclosed in U.S. Pat. No. 3,323,567 to A. R. Segal.

The hogging cutter of the Segal patent comprises, i;n general, a plurality of axially juxtaposed disc-like cutting elements, each generally resembling a circular saw blade. The several cutting elements differ in diameter from one another, and they are arranged stepwise according to diameter, with the smallest diameter cutting element at one axial end of the unit to serve as a trimming cutter and the larger diameter cutting elements serving as refuse cutters. Because of its generally frustoconical configuration, the hogging cutter of the Segal patent is sometimes referred to as a cone hogger.

A cone hogger is employed to trim an irregular edge of a plywood panel or the like to straightness and to size. The refuse cutters reduce the excess material of the panel to relatively small chips that can be readily sucked away from the cutting zone by means of a vacuum waste disposal system. The trimming cutter makes the actual trimming cut that defines the keepside edge. After the first cut made by the largest diameter refuse cutter, which is on the outside of the cone hogger, farthest from the keepside edge, each succeeding cutter produces less cutting pressure as it bites into the material, so that the trimming cutter, which enters the material last and is the last to leave it, can produce a straight, smooth edge on the trimmed workpiece.

The particular cone hogger embodiment disclosed in the Segal patent is illustrated as having its cutting elements maintained in concentric relationship to one another only by circumferentially spaced screws that secure the blades flatwise together. In commercial applications the cone hogger was provided with a generally tubular body member that extended axially through the several cutting elements to hold them concentric to itself and thus to one another. In effect the body member served as a heavy bushing that was common to all of the cutting elements and on which they were all carried, and the rotatable shaft or arbor on which the cone hogger was mounted was received in the bore in the body member.

To provide a secure anchorage of the cutting elements to the body member, the body member was made with a concentric enlarged diameter head portion at one axial end thereof. The smaller diameter portion of the body member extended through several of the largest diameter refuse cutters, and those cutting elements were flatwise secured to one another and to the head portion by means of circumferentially spaced screws that extended parallel to the axis of the unit and passed through those refuse cutters to be threaded into the head portion of the body member. The head portion, in turn, had sufficient axial length to extend through at least one other refuse cutter and the trimming cutter; and the cutting elements that were mounted on the head portion were secured by means of other circumferentially spaced screws that passed through those cutting elements and were threaded into the adjacent refuse cutter on the smaller diameter portion of the body member.

The cone hogger construction just described, while markedly superior in performance to prior hogging cutters, still did not produce a trimmed edge that was as straight and smooth as could be desired. The present invention resides, in part, in the discovery of the reasons why that prior cone hogger often produced a striated or slightly scalloped trimmed edge, and in part it resides in the provision of structure which overcomes the deficiencies of the prior cone hogger.

The reason the prior cone hogger did not always produce a nicely smooth trim cut was, briefly, that the head portion of the body member provided the only reference surface that established the orientations of the several cutting elements, and there could be an accumulation of tolerance errors between that reference surface and the trimming cutter inasmuch as the trimming cutter was connected with that reference surface only through its connection with the refuse cutters. As a result of such "stacking of tolerances," the trimming cutter could have a substantial amount of so-called side runout that caused it to wobble in its cut.

Considered in more detail, it will be evident that the flatwise orientation of the largest diameter refuse cutters was controlled by the shoulder surface on the head portion of the body member, against which the largest diameter refuse cutters were flatwise confined and which served as the reference surface that established their orientations. If that surface did not lie exactly in a single plane accurately normal to the rotational axis of the unit, its inaccuracies were imposed upon its adjacent refuse cutter and all cutting elements connected thereto. In like manner, any inaccuracy in the face of a refuse cutter body would be imposed upon cutting elements axially outward of that face, and each cutting element between the reference surface and the trimming cutter would contribute its inaccuracies to the total inaccuracy of the trimming cutter. Hence, even though inaccuracies in the individual components would all lie within close tolerance limits, the accumulated inaccuracies, imposed upon the trimming cutter, could substantially exceed tolerable limits.

In addition, the reference surface was of relatively small diameter, and, by a sort of leverage effect, its inaccuracies are magnified at the substantially larger diameter orbit of the trimming cutter teeth.

Similarly, the point of attachment between the largest diameter refuse cutter and the head portion of the body member was near the axially opposite end of the body from that refuse cutter, and the screws which secured that refuse cutter to the head had to be relatively near the axis of the unit and thus at a substantial distance from the teeth on that cutter. Thus the points of anchorage of the largest diameter cutters were about as far away from their teeth as they could be placed, and, accordingly, the teeth, in engaging a workpiece, could exert tremendous leverage in directions to impart flatwise twisting, vibratory and oscillatory forces to the refuse cutters. The trimming cutter was virtually compelled to partake of all undesirable vibrations and deformations of the refuse cutters because it was secured only to the refuse cutters.

To some extent the vibration inducing forces could be minimized by providing the refuse cutters with a relatively large number of teeth, so that each tooth would take a relatively small bite and would thus impose smaller forces on its blade. This expedient was not really satisfactory, however. Normally the teeth of a cone hogger have expensive individually installed tips of carbide or other hard metal, and every additional tooth on a cutter represents a substantial item of cost.

As has been indicated, it was not easy to discover the reasons for the deficiencies in the prior structure, but even when their cause was known, they were by no means easy to overcome without failing to meet other requirements. The body member of a cone hogger must accommodate a substantial number of flat circular blades — never less than three and sometimes as many as seven. Each blade is relatively thin in its axial dimension, yet every blade must be positively constrained to rotate with the body member as well as being confined against flatwise displacement to the greatest possible extent and held perfectly perpendicular to the axis of the unit. There should be no difficult or unusual machining problems in the manufacture of the body member, nor should the need for cooperation with it impose unusual requirements upon the cutting elements. The cutting elements should be readily separable from one another and from the body member to facilitate the sharpening of the hard metal tooth tips that is required periodically. Naturally the body member must be sturdy and must provide for secure and sturdy attachment of the cutting elements thereto, and it must not interfere with static and dynamic balance of the cone hogger about its rotational axis, having in mind that a cone hogger unit weighs on the order of sixty pounds and rotates at high speed.

It is of course the general object of this invention to provide a structural arrangement for a cone hogger unit that fully meets the requirements and desiderata set forth above.

Another object of the invention is to provide a cone hogger having cutting elements which are generally similar to the blade of a circular saw and having a rigid body member which extends axially through its several cutting elements, wherein the trimming cutter is secured directly to the body member, to be rigidly supported thereby, rather than being secured to other cutting elements for connection with the body member through them and thus being subjected to accumulated tolerance errors.

A further and more specific object of the invention is to provide a cone hogger unit having a body member upon which cutting elements are concentrically mounted and wherein the cutting elements are flatwise secured to the body member by circumferentially spaced screws or other securement means that extend parallel to the axis of the unit and are spaced at very substantial distances from that axis to enable the cutting elements to have optimum resistance to flatwise displacement.

It is also an object of this invention to provide a cone hogger having a body member to which disc-like cutting elements are secured and which establishes the flatwise orientation of the cutting elements, wherein any inaccuracies in the body member are not substantially magnified at the peripheral portions of the cutting elements.

With these observations and objectives in mind, the manner in which the invention achieves its purpose will be appreciated from the following description and the accompanying drawing, which exemplify the invention, it being understood that changes may be made in the specific apparatus disclosed herein without departing from the essentials of the invention set forth in the appended claims.

Figure 2:
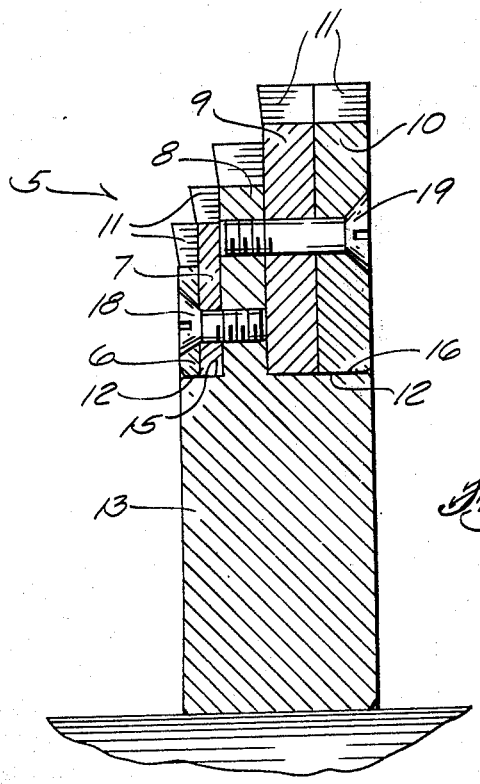

The accompanying drawing illustrates one complete example of an embodiment of the invention constructed according to the best mode so far devised for the practical application of the principles thereof, and in which:

FIG. 1 is a perspective view of a cone hogger embodying the principles of this invention; and FIG. 2 is a fragmentary sectional view of the cone hogger, taken on a plane lying on its axis.

Referring now to the accompanying drawing, the numeral 5 designates generally a cone hogger which embodies the principles of this invention and which comprises a plurality of disc-like cutting elements 6–10, each having on its periphery circumferentially spaced teeth 11 that comprise tips of hard metal such as carbide. With one exception discussed below, each of the cutting elements generally resembles a circular saw blade, although the central hole 12 in each cutting element is substantially larger than the conventional shaft hole in such a blade, to accommodate a body member 13 that extends axially through the several cutting elements.

The cutting elements 6–10 are arranged concentrically, in axial juxtaposition to one another. They are of several different diameters, the smallest diameter one, designated by 6, being a trimming cutter at one axial end of the unit, and the other cutting elements 7–10 being thicker refuse cutters of stepwise increasing diameter with increasing axial distance from the trimming cutter.

In this case the refuse cutter 10 that is axially farthest from the trimming cutter is of the same diameter as its adjacent refuse cutter 9. It constitutes a so-called filler blade that increases the effective cutting width of the hogger, and because of its axial distance from the trimming cutter its diameter is not as critical as that of refuse cutters which are nearer the trimming cutter and which therefore have more influence upon the quality of the cut made by the trimming cutter.

In accordance with the principles of the present invention, one of the refuse cutters, here designated by 8, comprises an integral part of the bodymember 13, and in that one respect the cutting element 8 is the exceptional one that does not resemble a conventional circular saw blade. The body member 13 also comprises a pair of concentric hub-like cylindrical portions 15 and 16 which project axially in opposite directions beyond the respective flat faces of the cutting element 8.

One of the hub-like portions of the body member, designated by 15, extends through the trimming cutter 6, and in this case also extends through its adjacent refuse cutter 7, the holes in the cutting elements 6 and 7 being of such size as to closely fit the cylindrical portion 15. The other hub-like portion 16 of the body member extends through the remaining refuse cutters 9 and 10, and, again, the central holes in those cutting elements are of such size as to closely fit that hub-like portion.

Preferably the cutting element 8 is formed in one piece with the hub-like portions 15 and 16 of the body member, but the cutting element 8 and the remainder of the body member could be made as separate parts rendered effectively integral with one another as by welding. The overall axial length of the body member will be at least substantially equal to the axial distance between the outer flat faces of the endmost cutting elements of the unit.

The cutting elements 6 and 7 that are mounted on the cylindrical hub-like portion 15 of the body member are secured to the body member by means of circumferentially spaced screws 18 that extend parallel to the axis of the hogger unit and pass through those cutting elements to be threaded into the cutting element 8. The screws 18 can therefore be located at a very substantial distance from the rotational axis of the unit, not far in from the gullets of the teeth on the trimming cutter, and therefore they have good purchase on the trimming cutter to confine it against flatwise displacment relative to the cutting element 8. And since the screws 18 are spaced well out from the axis of the unit, the central hole in each of the cutting elements 6 and 7 can be of large diameter, and in turn the cylindrical body portion 15 can have a large diameter. This means that each of the blade-like cutting elements 6, 7 and 8 can have limited radial extent so as to be rigidly resistant to flatwise deformation. In general, the cylindrical portion 15 of the body member can have a diameter equal to at least half the outside diameter of the trimming cutter.

The largest diameter refuse cutters, which are mounted on the other hub-like portion 16 of the body member, are secured by other circumferentially spaced screws 19 that extend parallel to the axis of the unit and are threaded into the cutting element 8. Again, the screws 19 are located as close as practicable to the peripheries of the cutting elements that they secure and are thus spaced at a greater distance from the axis of the unit than the screws 18.

However many cutting elements there may be in a cone hogger unit that embodies the principles of this invention, it will be evident that the cutting element that is formed integrally with the hub-like portions 15 and 16 should be one of the refuse cutters, which will of course have a diameter larger than that of the trimming cutter and will thus provide a large, stable reference surface by which the trimming cutter is accurately oriented. The particular refuse cutter that is integrated into the body 13 will in any case be one that is sufficiently thick to afford good engagement with the threaded end portions of the screws 18 and 19, having in mind that the refuse cutters of a cone hogger are ordinarily of increasing thickness with increasing axial distance from the trimming cutter. If the cone hogger has relatively few cutting elements (e.g., three), the body-integrated refuse cutter can be an axially endmost cutting element, but in this connection it should be borne in mind that there should not be more than one or two refuse cutters between the body-integrated refuse cutter and the trimming cutter to avoid an accumulation of individually tolerated inaccuracies that could be large enough in sum to cause side runout of the trimming cutter.

It will be appreciated that securing the trimming cutter to a correctly selected one of the refuse cutters that is integrated with the body will afford more rigidity and stability than if the trimming cutter were itself integrated with the body, owing to the fact that the trimming cutter is thinner than any of the refuse cutters.

It will be evident that the cylindrical portion 16 of the body member, upon which the largest diameter cutting elements 9 and 10 are mounted, could have a larger diameter than the opposite cylindrical portion 15, in order to ensure a more stable and rigid base for the largest diameter cutting elements. In that case the body member portion 16 could be of such diameter that the axially inner screws 18 could enter it for extra-secure purchase of their threaded end portions. In most cases, however, a body member having cylindrical hub-like portions of equal diameter will provide such satisfactory results that any greater cost of making those portions with different diameters would not be justified.

From the foregoing description taken with the accompanying drawing it will be apparent that this invention provides a cone hogger unit structure wherein the cutting elements are so connected with one another and with a body member as to be properly oriented relative to the axis of the unit without an accumulation of tolerance errors, and wherein the cutting elements are rendered so rigid that their teeth are effectively confined to true orbits so that a finished edge produced by the unit will be straight and smooth.

Those skilled in the art will appreciate that the invention can be embodied in forms other than as herein disclosed for purposes of illustration.

The invention is defined by the following claims:

1. A combination circular refuse and trim saw unit of the type comprising a plurality of disc-like cutting elements, each having circumferentially spaced teeth around its periphery, said cutting elements being coaxial and axially juxtaposed, with a smallest diameter cutting element at one axial end of the unit and comprising a trimming cutter, the remaining elements being thicker and larger diameter refuse cutters that are of stepwise increasing diameter with increasing axial distance from the trimming cutter, said unit being characterized by:

A. one of said refuse cutters comprising an integral portion of a body that also has a coaxial cylindrical portion projecting axially beyond one face of said refuse cutter;

B. the trimming cutter being annular and closely surrounding said cylindrical portion to be confined against radial displacement by it; and C. circumferentially spaced securement means extending parallel to the axis of the unit through the trimming cutter and into said body, said securement means being nearer to the periphery of the trimming cutter than to the axis of the unit so that the peripheral portion of the trimming cutter is confined against flatwise displacement out of an orientation established by said one face on said one refuse cutter.

2. The refuse and trim saw unit of claim 1, further characterized by:

D. said body further comprising a second coaxial cylindrical portion which projects axially beyond the other face of the first mentioned refuse cutter and which is closely surrounded by another refuse cutter to confine the latter against radial displacement; and E. other circumferentially spaced securement means extending parallel to the axis of the unit and into said body through said other refuse cutter, said other securement means being spaced at a greater distance from the axis of the unit than the first mentioned securement means.

3. A combination refuse and trim saw unit comprising a plurality of disc-like cutters, each having circumferentially spaced teeth on its periphery, said cutters being arranged concentrically and in axial juxtaposition, with a smallest diameter cutter at one axial end of the unit and comprising a trimming cutter, the other cutters being thicker and larger diameter refuse cutters that are of stepwise increasing diameter with increasing axial distance from the trimming cutter, said unit being characterized by:

A. one of the refuse cutters, intermediate the axial ends of the unit, having integral hub-like concentric cylindrical portions that project axially in opposite directions beyond the faces thereof;

B. the trimming cutter being annular and in closely surrounding relation to one of said cylindrical portions to be confined against radial displacement thereby;

C. another refuse cutter, of larger diameter than said one refuse cutter, being in closely surrounding relation to the other of said cylindrical portions to be confined against radial displacement thereby;

D. first circumferentially spaced securement means extending parallel to the axis of the unit, through the trimming cutter and into said one refuse cutter to confine the trimming cutter against axial displacement and maintain it in an orientation established by one face of said one refuse cutter; and E. second circumferentially spaced securement means extending parallel to the axis of te unit through said other refuse cutter of larger diameter and into said one refuse cutter, to confine said refuse cutter of larger diameter against flatwise displacement and maintain it in an orientation established by the other face of said one refuse cutter.

4. The unit of claim 3, further characterized by:

F. said second securement means being spaced at a substantially greater distance from the axis of the unit than said first securement means.

5. The unit of claim 3, further characterized by:

F. a further refuse cutter on said one cylindrical portion, closely surrounding the same, axially confind between the trimming cutter and said one refuse cutter and through which the first mentioned securement means also extend.

6. A combination refuse and trim saw unit of the type comprising a plurality of disc-like cutting elements, each having circumferentially spaced teeth on its periphery, said elements being coaxial and axially juxtaposed, with a smallest diameter element at one axial end of the unit and commprising a trimming cutter, the rest of the elements being axially thicker refuse cutters of larger diameter and being of stepwise increasing diameter with increasing axial distance from the trimming cutter, said unit being characterized by:

A. one of said refuse cutters being formed as a portion of a unitary body that also comprises coaxial cylindrical portions which project axially to opposite sides of said refuse cutter,

1. the radius of one of said cylindrical portions being equal to a major portion of the outside radius of the trimming cutter, and

2. the radius of the other of said portions being at least as large as the radius of said one cylindrical portion;

B. the trimming cutter being annular and closely surrounding said one cylindrical portion to be confined against radial displacement thereby;

C. circumferentially spaced securement means extending parallel to the axis of the unit, through the trimming cutter and into said body to confine the trimming cutter against flatwise displacement relative to said body;

D. at least one other refuse cutter being mounted on said other cylindrical portion, in closely surrounding relation thereto; and E. other circumferentially spaced securement means extending through said other refuse cutter and into said body to confine said other refuse cutter against flatwise displacement relative to the body, said other securement means being spaced at a greater distance from the axis of the unit than the first mentioned securement means.

7. A combination refuse and trim saw unit of the type comprising a plurality of concentric, axially juxtaposed disc-like cutting elements, each having circumferentially spaced teeth around its periphery, a smallest diameter cutting element being at one axial end of the unit and comprising a trimming cutter, the remaining cutting elements being thicker and larger diameter refuse cutters that are of stepwise increasing diameter with increasing axial distance from the trimming cutter, said unit being characterized by:

A. a central body by which all of the cutting elements are established in concentric relation to one another and which comprises

1. a pair of axially oppositely projecting cylindrical portions, a. one of said cylindrical portions extending through a closely fitting central hole in the trimming cutter, b. the other of said cylindrical portions extending through a closely fitting central hole in the refuse cutter farthest from the trimming cutter, and

2. said central body further comprising an axially intermediate portion of substantially larger diameter than said cylindrical portions, integral and concentric with them, said axially intermediate portion having a thickness not substantially greater than that of the largest diameter refuse cutter and having opposite axially facing flat surfaces against which its adjacent cutting elements are confined; and B. a plurality of elongated securement members, all extending lengthwise parallel to the axis of the unit and spaced at substantial distances therefrom,

1. certain of said securement members extending through the trimming cutter and being secured in said intermediate portion of the body to confine the trimming cutter against axially outward displacement, and

2. the remainder of said securement members extending through said refuse cutter farthest from the trimming cutter and being seured in said intermediate portion of the body to confine that refuse cutter against axially outward displacement.

* * * * *